US005299602A

United States Patent [19]

Barbeau et al.

[11] Patent Number: 5,299,602

[45] Date of Patent: Apr. 5, 1994

[54] TEXTILE MATERIAL FOR OUTER SHELL OF FIREFIGHTER GARMENT

[76] Inventors: Claude Barbeau, 177A de Navarre, St-Lambert, Quebec, Canada, J4S 1R5; Ross Cochran, 215 St-Laurent, Apt. 34, Montreal, Quebec, Canada, H2Y 3T9

[21] Appl. No.: 31,112

[22] Filed: Mar. 12, 1993

[51] Int. Cl.[5] ..... D03D 15/12

[52] U.S. Cl. ..... 139/420 A

[58] Field of Search ..... 428/225, 902, 911; 139/420 A, 420 R; 2/243 A, 81, 2.5, 7, 8

[56] References Cited

U.S. PATENT DOCUMENTS 3,594,873 8/1970 Heckmeyer, Jr. ..... 139/384

4,602,384 7/1986 Schneider ..... 2/2

4,923,741 5/1990 Kosmo et al. ..... 428/911

5,136,723 8/1992 Aldridge et al. ..... 2/81

5,202,086 4/1993 Baliga et al. ..... 139/420 A

FOREIGN PATENT DOCUMENTS 0171755 10/1982 Japan ..... 139/420 R

*Primary Examiner*—Andrew M. Falik

[57] ABSTRACT

The textile material is a weave wherein the warps are made of multifilamentary aramid yarns, while the wefts comprise alternate multifilamentary aramid yarns and spun aramid yarns. When used in conjunction with a firefighter garment, the shell increases wearer comfort, reduces metabolic energy requirements and decreases metabolic heat build-up.

5 Claims, 1 Drawing Sheet

TEXTILE MATERIAL FOR OUTER SHELL OF FIREFIGHTER GARMENT

BACKGROUND OF THE INVENTION (a) Field of the Invention

This invention relates to a textile material for use as the outer shell of a firefighter garment. More particularly, the invention is concerned with the material of the outer shell of a firefighter garment that increases the mobility and comfort of the wearer and, overcomes the problem of decreasing mechanical resistance as fabric weight reduces.

(b) Description of Prior Art

All fabrics used in the manufacture of protective clothing for firefighters must satisfy minimum performance requirements for flame, heat and tear resistance, as well as for thermal protection in general.

The clothing is normally made of a composite layer of materials including an outer shell which is most often constructed of spun yarns. These spun yarn materials do not slide easily on themselves or on surfaces inside or outside (e.g. other layers of the garment) with which they come into contact. As a result, a certain amount of body energy is required to move in the garments or flex joints, and to otherwise perform functions associated with the job of the wearer.

In the design of an outer shell, care must be taken not to fall below the minimum performance requirements of the various national standards. For example, a garment could be made lighter by simply employing lighter weight outer shell fabrics, however, as fabric weight drops, so does its mechanical resistance.

One method for overcoming the decrease in mechanical resistance as fabric weight decreases is to use filament instead of spun yarns, the former having very high tensile and abrasion strength. Similarly, filament yarns are more slippery than spun yarns thereby reducing friction between the filament fabric and any other fabric with which it may come in contact. This slipperiness increases the flexibility and mobility of the garment thereby reducing metabolic heat build-up.

However, filament fabrics often have problems as a result of the filament type or the fabric weave:

plain weave filament fabrics often suffer from seam slippage;

100% NOMEX ® filament fabrics experience break-open before spun NOMEX ®/KEVLAR ® blends;

100% KEVLAR ® filament is vulnerable to UV. degradation and to fibrillation.

One of the leading causes of firefighter injury and mortality is stress. Stress may be caused by metabolic heat build-up and retention which in turn may be partly caused by the weight of the garment, the insulation properties of the garment, or the impediments to movement that the garment may present. Even if circumstances are not severe enough to make heat stress a threat, wearer comfort is decreased if the garment is heavy and constricting.

U.S. Pat. No. 4,583,247 describes a heat insulating garment made of a composite interlining sheet of porous material having low heat conductivity and high resilience. A layer of flexible reflective material is bonded to the outside of the porous material.

U.S. Pat. No. 4,897,886 describes a firefighter's garment having an outer layer, an intermediate layer, and an inner layer. Spacer elements are disposed between two of the layers of the garment to provide air spaces between layers of the garment. This design seeks to enhance thermal protective performance without significantly increasing garment weight. Its primary objectives are not:

reduction in garment weight nor enhanced mobility nor equal or superior heat and mechanical resistance at lower fabric weights.

U.S. Pat. No. 4,892,757 relates to fire block textile material including a carrier means and a textile to provide cover in a first state and a fire block or barrier in a second state.

U.S. Pat. No. 4,922,522 describes a design which seeks to increase flexibility at certain places in the garment by reducing the fabric thickness in these specific areas. Coincidentally, this would provide a very small reduction in garment weight.

U.S. Pat. No. 5,001,781 seeks to increase thermal protection and hence weight and thickness in only selected areas of the garment.

U.S. Pat. No. 5,136,723 discloses a firefighter garment including an outer shell, a moisture barrier within the shell and an inner thermal barrier. The outer shell may be made of NOMEX ® or KEVLAR ® fibers. The moisture barrier may be made of NOMEX ® fibers and the thermal barrier may have a face cloth of NOMEX ® or KEVLAR ®. The aim of this Patent is the promotion of moisture vapor (perspiration) transmission from the inside to the outside of the garment without sacrificing thermal protective performance.

It is object of the present invention to provide a textile material for the outer shell of a firefighter garment that increases wearer comfort, reduces metabolic energy requirements and decreases metabolic heat build-up.

It is another object of the present invention to reduce the overall weight of the garment without compromising the mechanical resistance of the layers of the fabric.

It is another object of the present invention to provide an outer shell for firefighter garments that reduces the coefficients of static and sliding friction between the layers of the garment and between the garment and other interior or exterior surfaces which it may contact.

It is another object of the present invention to reduce the bulk of material at flex points of a firefighter garment such as at the elbows, shoulders, knees, underarms, and hence reduce mechanical resistance to body movement.

SUMMARY OF INVENTION

In accordance with a preferred embodiment of the present invention, there is provided a textile material to constitute an outer shell fabric for firefighter garments. The textile material consists of a weave including warps and wefts. The warps are comprised of mutifilament aramid yarns and the wefts are comprised of multifilamentary aramid yarns and spun aramid yarns.

In accordance with a further broad aspect of the present invention, there is provided an outer shell fabric for firefighter garments, the textile material consists of a weave including warps and wefts. The warps are comprised of multifilament aramid yarns.

In accordance with a preferred embodiment of the invention, the multifilamentary aramid yarns present in the wefts are similar to one of the two alternately arranged different multifilamentary aramid yarns forming the warps.

In accordance with another preferred embodiment of the invention, the warps comprise alternate multifilamentary NOMEX® and KEVLAR® yarns, and the wefts comprise alternate spun NOMEX® yarns and multifilamentary KEVLAR® yarns.

In order to obtain a more supple and flexible textile material, the weave is a twill weave.

BRIEF DESCRIPTION OF DRAWING

The invention is illustrated but is not restricted by the annexed drawing of a preferred embodiment, in which.

DESCRIPTION OF PREFERRED EMBODIMENT

Figure 1:
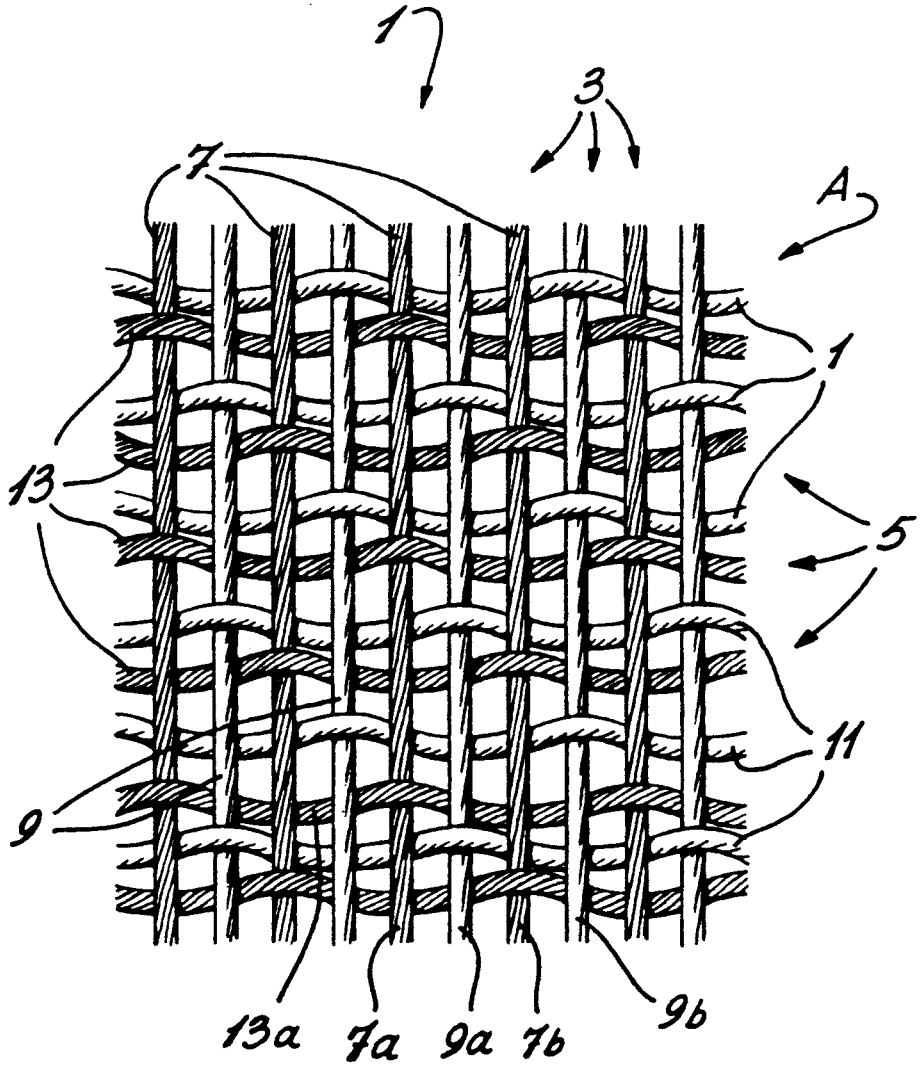
FIG. 1 is an illustration on an enlarged scale of a textile material for the outer shell of a firefighter garment.

Referring to the drawings, it will be seen that the textile material is a weave 1 which includes an arrangement of warps 3 and wefts 5. Instead of utilizing similar types of yarns for all warps, the latter consist of an alternate distribution multifilamentary NOMEX® yarns 7 and multifilamentary KEVLAR® yarns 9. NOMEX® and KEVLAR® are well known aramid fibers sold by DuPont. Of course other types of aramid fibers could be used without departing from the invention.

Turning now to the wefts, the latter will be seen to consist of an alternate arrangement of multifilamentary KEVLAR® yarns 11 and spun NOMEX® yarns 13.

It will also be realized that the weave 1 is a twill weave 3 by 1. For instance, it will be seen that spun NOMEX® yarn 13*a* is passed over multifilamentary NOMEX® yarn 7*a*, then under multifilamentary KEVLAR® yarn 9*a*, multifilamentary NOMEX® yarn 7*b*, multifilamentary KEVLAR® yarn 9*b*, after which it is passed over multifilamentary NOMEX® yarn 7*c*. The process is repeated with all warps and wefts as illustrated to produce a twill weave.

NOMEX® and KEVLAR® yarns have been chosen because of the dyeability and fire-resistance of the NOMEX® yarns, the higher thermal break-open resistance of KEVLAR® and the higher mechanical resistance to weight ratio of NOMEX® and KEVLAR® filament fabrics as compared to their spun yarn equivalents. Thermal break-open is known in the art as the change in condition of the fabric or yarns as it approaches and reaches its carbonization temperature. At that temperature the fabric breaks open either with or without the application of external mechanical forces.

It is also understood that other yarns of the aramid, polyimid, or polybenzimidazole families may also be used without departing from the scope and spirit of the present invention.

We claim:

1. A textile material to constitute an outer shell fabric for firefighter garments, said textile material consisting of a weave including warps and wefts, said warps comprising multifilamentry aramid yarns, said wefts comprising alternate multifilamentary aramid yarns and spun aramid yarns.

2. A textile material according to claim 1, said warps comprising at least two alternately arranged different multifilamentary aramid yarns.

3. A textile material according to claim 2, wherein the multifilamentary aramid yarns present in said wefts, are identical to one of the two alternately arranged different multifilamentary aramid yarns forming said warps.

4. A textile material according to claim 3, wherein the warps comprise alternate multifilamentary NOMEX® and KEVLAR® yarns and the wefts comprise alternate multifilamentary KEVLAR® yarns and spun NOMEX® yarns.

5. A textile material according to claim 4, wherein said weave is a twill weave.

* * * * *